United States Patent [19]

Byrne

[11] Patent Number: 4,481,959

[45] Date of Patent: Nov. 13, 1984

[54] FILTERING MEANS

[75] Inventor: Stanley W. Byrne, North Crawley, England

[73] Assignee: American Filtrona Corporation, 8401, Richmond, Va.

[21] Appl. No.: 394,780

[22] Filed: Jul. 2, 1982

[30] Foreign Application Priority Data

Jul. 6, 1981 [GB] United Kingdom ..... 8120822

[51] Int. Cl.[3] ..... A24D 3/04

[52] U.S. Cl. ..... 131/336; 131/338; 131/339; 131/361

[58] Field of Search ..... 131/336, 338, 339, 361, 131/362

[56] References Cited

U.S. PATENT DOCUMENTS

| | | | |
|---|---|---|---|
| 3,490,461 | 1/1970 | Osmalou et al. | 131/336 |
| 4,256,122 | 3/1981 | Johnson | 131/336 |
| 4,357,950 | 11/1982 | Berger | 131/344 |

FOREIGN PATENT DOCUMENTS 955639 4/1964 United Kingdom .

*Primary Examiner*—V. Millin

*Attorney, Agent, or Firm*—Holman & Stern

[57] ABSTRACT

A tobacco smoke filter comprising an axially elongate filtering core 4, and a plugwrap 2 in surrounding engagement with the core and extending axially therebeyond to define a recess 6, the outer surface of the plugwrap providing at least one channel 8 extending longitudinally of the filter from an end 16 thereof.

6 Claims, 3 Drawing Figures

FILTERING MEANS

The present invention relates to tobacco smoke filters and provides such a filter comprising an axially elongate filtering core, and a plugwrap in surrounding engagement with the core and extending axially therebeyond to define a recess, the outer surface of the plugwrap providing at least one channel extending longitudinally of the filter from an end thereof.

The plugwrap may for example be longitudinally corrugated or grooved to provide such channels.

In one preferred type of embodiment, the plugwrap is air-impermeable, at least where the longitudinal extending channels are formed. These channels preferably extend from the recess end of the plugwrap only partially towards the other end, and most preferably do not overlap longitudinally with the filtering core. Such a filter is suitable for use with a ventilating overwrap—which may be a tipping overwrap incorporating the filter in a filtered cigarette, the overwrap providing, in use of the filter, for the ingress of external ventilating air laterally therethrough into the channels; the overwrap may be of inherently air-permeable material or (especially when it is a tipping overwrap) of air-impermeable material provided with ventilating perforations opening directly into the channels. Such a filter may be employed with the recess exposed at the buccal end or disposed against the tobacco rod. The plugwrap could project axially beyond the core in opposite directions to define recesses at both ends of the filter, and each end could be as described above, i.e. with the channels extending from each end of the filter towards the filtering core but not overlapping longitudinally with the filtering core; a ventilating overwrap could provide for ventilation therethrough into each set of channels.

In another type of embodiment, a said channel commences part way along a said recess and extends therefrom the full length of the filtering core to the other end of the filter. In this case, the plugwrap is preferably of smoke-impermeable material, the or each said channel at its closed end portion over said channel having one or more apertures or perforations therethrough which are smoke-permeable but which are progressively blocked by the passage of unfiltered tobacco smoke therethrough. Such a filter can be employed in a filtered cigarette with said recess open at the buccal end and said channel or channels open directly to the tobacco column. On smoking, smoke from the tobacco column initially passes freely up the or each channel, through the or each said perforation or aperture into said recess and hence substantially unfiltered directly into the smokers mouth; after a few puffs (e.g. two or three or four) however, the perforations or apertures are progressively blocked so that an increasing amount of smoke is obliged to travel instead through the filtering core to reach said recess and the smokers mouth. Compared to a conventional filter, this filter according to the invention thus gives unusually good taste delivery over the first few puffs with the degree of filtration then increasing during subsequent smoking; in this way, for a given overall tar delivery, it is possible to provide a more even tasting smoke from first to last puff.

Impermeable plugwrap for use in the invention could for example be a paper/thermoplastics polymer/paper laminate corrugated to provide the said channels. Such a plugwrap may for example be provided with longitudinal extending corrugations, transverse corrugations or plain uncorrugated portions being provided where the resulting longitudinal channels are to terminate. Another possibility is heavy gauge (e.g. 100 g/m$^2$ or more) paper such as cartridge paper having longitudinal grooves formed therein, e.g. by means of profiled impressing rolls. The paper can simply be left plain where the resulting channels are to terminate.

The invention is illustrated, by way of example only, with reference to the accompanying drawings, in which like reference numerals indicate like parts and in which.

Figure 1:
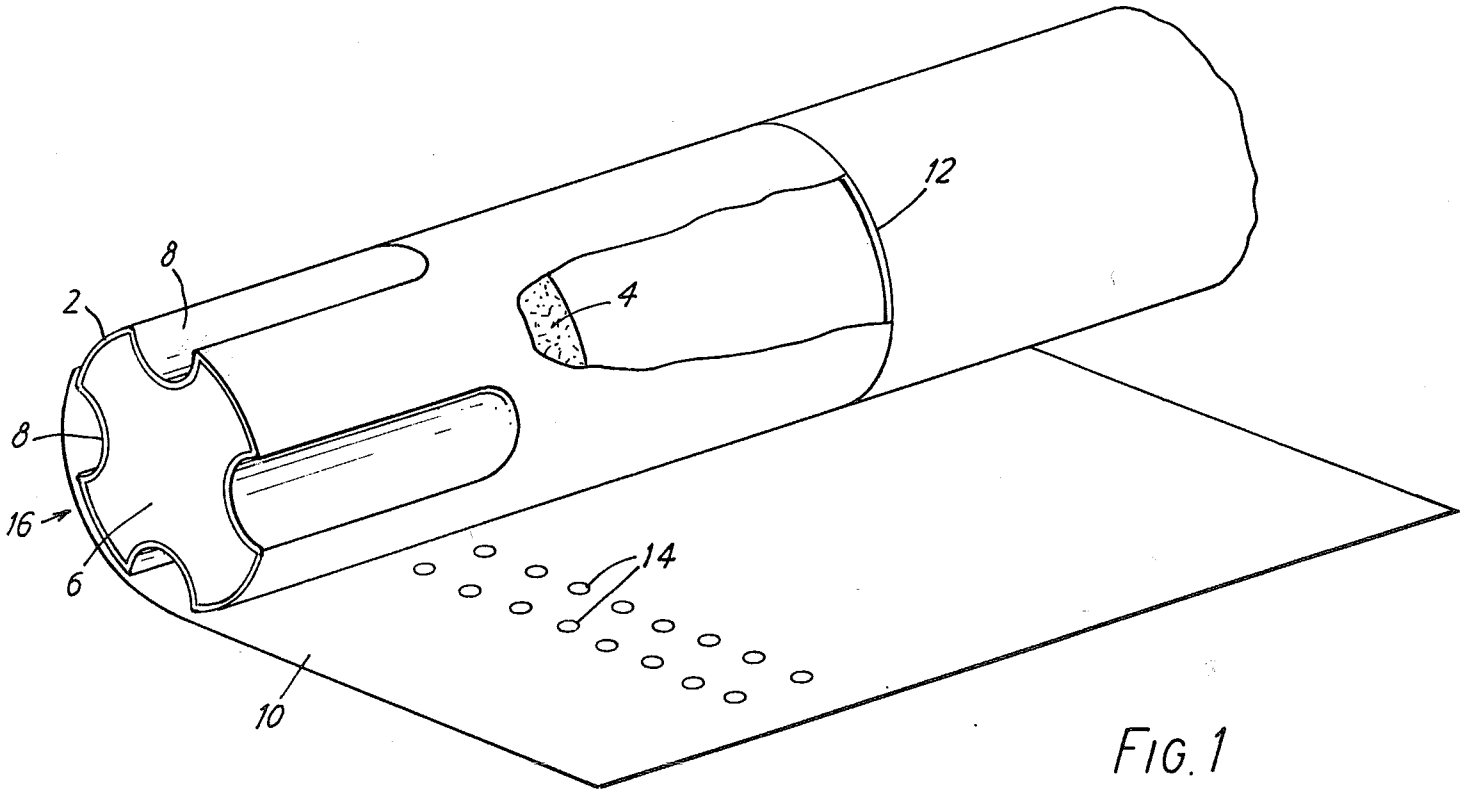
FIG. 1 is a diagrammatic perspective view of a filter according to the invention incorporated in a filtered cigarette, with parts broken away and with the tipping overwrap partially unwrapped.

In FIG. 1 the filter according to the invention comprises a plugwrap 2 in engagement around a filter plug 4 and extending axially therebeyond to define a recess 6. The plugwrap 2 is of air-impermeable cartridge paper. In this plugwrap are formed four longitudinal grooves 8 which extend longitudinally from the open end 16 of the recess and terminate short of its other end, there being no overlap of the grooves 8 with the filter plug 4 around which the plugwrap 2 is plain. For a filter of about 8 mm. total diameter, the grooves 8 will for example be about 1 mm. deep.

A tipping overwrap 10 joins the filter to a wrapped tobacco rod 12, the tipping overwrap having perforations 14 therethrough via which, in use, external air is drawn into the grooves 8 when the cigarette is smoked.

Figure 2:
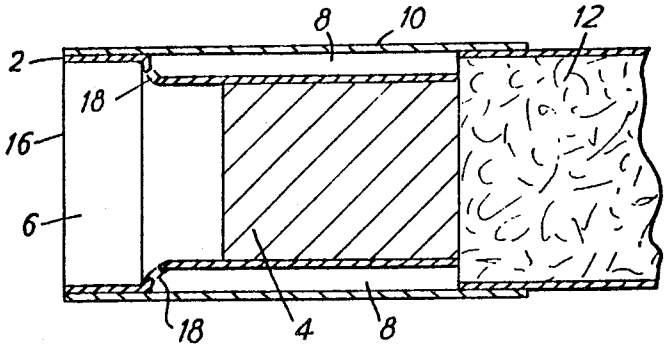
FIG. 2 is a diagrammatic longitudinal sectional view through another filter according to the invention incorporated in a filtered cigarette.

The FIG. 2 embodiment employs a plugwrap 2 of the same cartridge paper (100 g/m$^2$) as in the FIG. 1 embodiment and provided with four circumferentially symmetrically spaced longitudinal grooves 8 about 1 mm. deep. In this case, however, the grooves 8 extend along the length of filter plug 4 and partially along the axially projecting portion of plugwrap 2 which defines recess 6, so that this recess 6 at its open end 16 is of circular section. The grooves 8 are impressed into the peripheral surface of plug 4, so that plug 4 has a profile corresponding to that of the end 16 of recess 6 in FIG. 1. At the closed end of each groove 8 around recess 6 is at least one small aperture 18 which is smoke-permeable but progressively blocked by the passage of unfiltered tobacco smoke therethrough. An imperforate, smoke-impermeable tipping overwrap 10 joins the filter to wrapped tobacco rod 12. On smoking, the tobacco smoke from rod 12 initially passes unfiltered along grooves 8 and through perforations 18 into cavity 6, but as the perforations block more smoke is obliged to travel through filter plug 4; the taste delivery over the whole smoke is thus more even from first to last puff than is the case with conventional filtered cigarettes.

Figure 3:
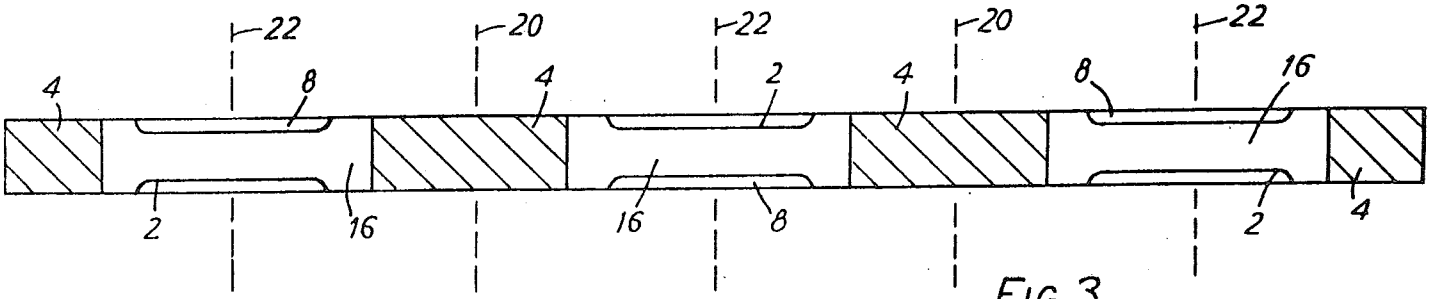
FIG. 3 is a diagrammatic longitudinal sectional view of a multiple length filter rod according to the invention, for severing into individual FIG. 1 filters.

In the production of filters as shown in FIGS. 1 and 2, the plugwrap 2 is preferably initially supplied plain and then has the grooves 8 impressed or embossed therein before wrapping around the filter plug. Where apertures 18 are required as in FIG. 2 they can be made before, simultaneously with or after groove formation, and they are conveniently provided fairly closely spaced across the whole width of the plugwrap—those not falling within the grooves 8 eventually being sealed off by overwrap 10 and so having no effect. Usually a continuous length of the pre-profiled plugwrap will be continuously wrapped around a string of the spaced filter plugs and the resulting composite rod severed transversely into finite lengths. These finite lengths, in which the filter manufacturer will supply the filter for filter cigarette production, will usually be an even multiple (e.g. sextuple) of the length of the eventual individual filter. The cigarette manufacturer will then first cut these initial multiple lengths into double lengths, each double length will then be longitudinally abutted between tobacco rods and joined thereto by tipping overwrap, and the resulting assembly severed midway through the double length filter to give two filter cigarettes. The double and even multiple length rods, which unlike the individual filters are symmetrical (having a core or recess at both ends depending upon whether recess or core is to be at the buccal end of the filter cigarette product), are also part of this invention. FIG. 3 illustrates such a sextuple rod which would first be cut at 20 into double lengths, these in turn being cut at 22 after application of a tipping overwrap in filter cigarette production as described above, to yield filter cigarettes of the type shown in FIG. 1.

Instead of the illustrated plugwrap 2, one could employ to equal effect in either of the illustrated embodiments an impermeable plugwrap longitudinally corrugated to provide external channels equivalent to grooves 8, these external channels being terminated at a portion of the plugwrap which is plain or provided with circumferential corrugations or otherwise appropriately configured.

What is claimed is:

1. A tobacco smoke filter comprising an axially elongate filtering core, and a plugwrap in surrounding engagement with the core and extending axially therebeyond to define a recess, the outer surface of the plugwrap providing at least one channel extending longitudinally of the filter from an end thereof, wherein at least one said channel commences part way along said recess and extends therefrom the full length of the filtering core to the other end of the filter.

2. A filter according to claim 1 wherein the plugwrap is of smoke-impermeable material, the or each said channel at its closed end portion over said channel having one or more apertures or perforations therethrough which are smoke-permeable but which are progressively blocked by the passage of unfiltered tobacco smoke therethrough.

3. A filter according to claim 2 having a smoke-impermeable outer wrap therearound and secured to a wrapped tobacco rod with the or each said channel open to the tobacco.

4. A cigarette incorporating a filter according to claim 3.

5. A rod comprising a plurality of unit filters according to claim 1 disposed end-to-end and integrated by a common said plugwrap extending the full length of the rod, each said unit filter being disposed in mirror-image relationship to the or each integrally adjacent unit filter.

6. A rod according to claim 5 having a said core at each end thereof.

* * * * *